US007815338B2

(12) United States Patent
Siemiet et al.

(10) Patent No.: US 7,815,338 B2
(45) Date of Patent: Oct. 19, 2010

(54) LED LIGHTING UNIT INCLUDING ELONGATED HEAT SINK AND ELONGATED LENS

(75) Inventors: Dennis Siemiet, Rochester Hills, MI (US); David L Simon, Grosse Pointe Farms, MI (US); Huaiyao Yuan, Buffalo Grove, IL (US)

(73) Assignee: Altair Engineering, Inc., Troy, MI (US)

( * ) Notice: Subject to any disclaimer, the term of this patent is extended or adjusted under 35 U.S.C. 154(b) by 225 days.

(21) Appl. No.: 12/040,901

(22) Filed: Mar. 2, 2008

(65) Prior Publication Data

US 2009/0219713 A1 Sep. 3, 2009

(51) Int. Cl.
*F21V 29/00* (2006.01)

(52) U.S. Cl. ..... 362/218; 362/294; 362/373; 362/249.02

(58) Field of Classification Search ..... 362/218, 362/294, 373, 249.02, 800
See application file for complete search history.

(56) References Cited

U.S. PATENT DOCUMENTS

| | | | | |
|---|---|---|---|---|
| 6,371,637 | B1 | 4/2002 | Atchinson et al. | |
| 7,049,761 | B2 | 5/2006 | Timmermans et al. | |
| 7,165,863 | B1 | 1/2007 | Thomas et al. | |
| 7,307,391 | B2 | 12/2007 | Shan | |
| 7,350,936 | B2 | 4/2008 | Ducharme et al. | |
| 2005/0265019 | A1 * | 12/2005 | Sommers et al. | 362/217 |
| 2006/0146531 | A1 * | 7/2006 | Reo et al. | 362/244 |
| 2006/0193131 | A1 | 8/2006 | McGrath et al. | |

FOREIGN PATENT DOCUMENTS

| | | | |
|---|---|---|---|
| JP | 2004335426 | A | 11/2004 |
| KR | 0018233 | * | 11/2006 |
| KR | 200430022 | Y1 | 11/2006 |
| KR | 100888669 | B1 | 3/2009 |

OTHER PUBLICATIONS

Written Opinion of the ISA and International Search Report dated Aug. 25, 2009 from the corresponding International Application No. PCT/US2009/031049 filed Jan. 15, 2009.

* cited by examiner

*Primary Examiner*—Stephen F Husar
*Assistant Examiner*—James W Cranson
(74) *Attorney, Agent, or Firm*—Young Basile

(57) ABSTRACT

A LED lighting unit including an elongated heat sink having two spaced apart longitudinal grooves, the grooves facing tangentially or at an angle greater than an angle between a tangent of the lighting unit at the groove and a radius of the lighting unit at the groove. At least one LED is mounted to the heat sink between the grooves, and the at least one LED is enclosed by a lens having bulged longitudinal edges by sliding the bulged longitudinal edges into the grooves.

21 Claims, 2 Drawing Sheets

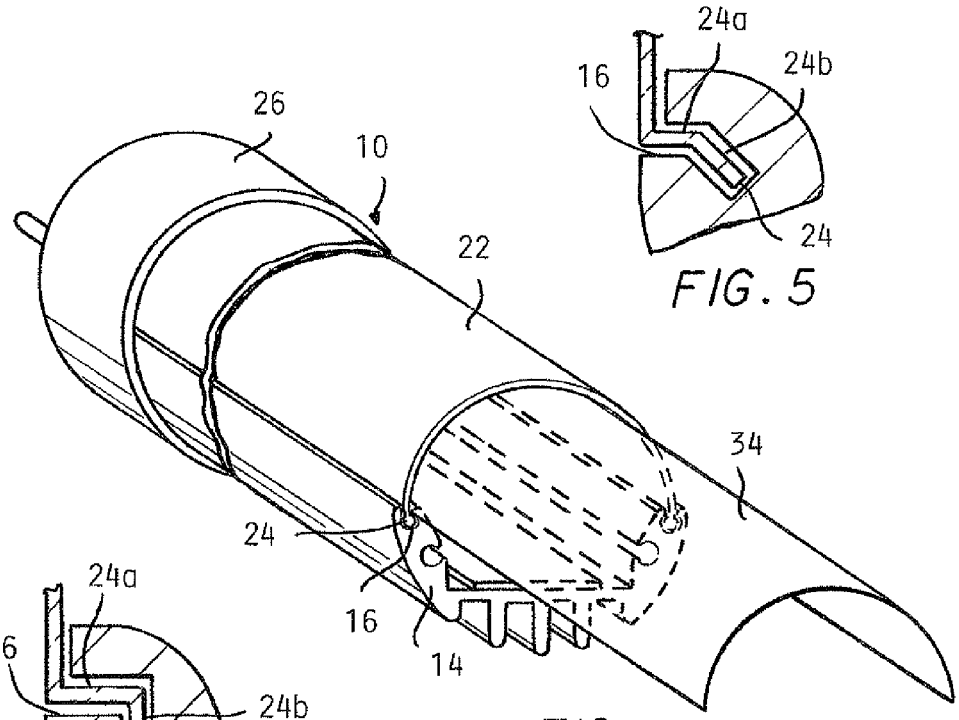
FIG. 4
FIG. 5
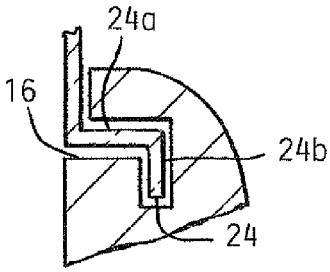
FIG. 6
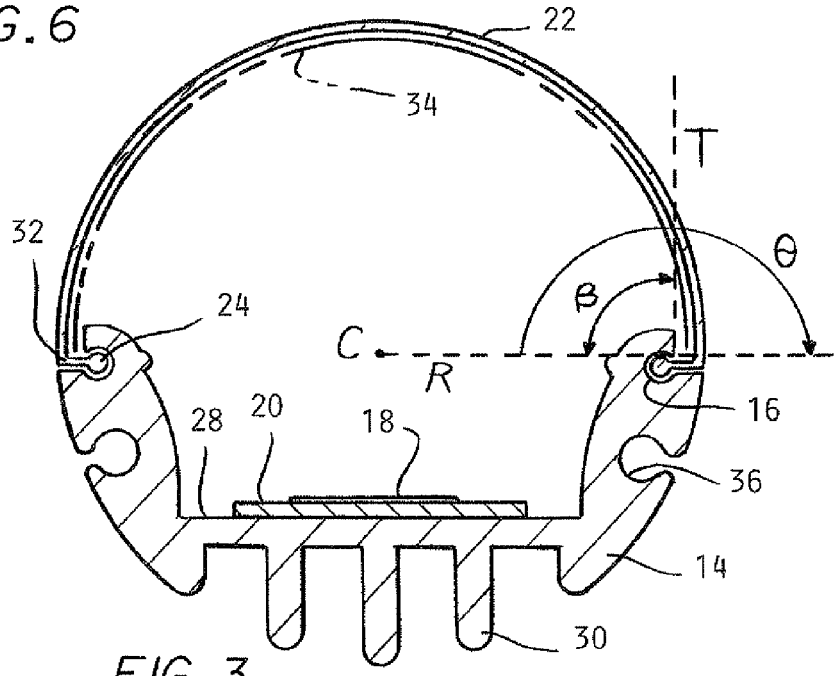
FIG. 3

LED LIGHTING UNIT INCLUDING ELONGATED HEAT SINK AND ELONGATED LENS

TECHNICAL FIELD

The invention relates to an LED housing including a lens and a heat sink that retains the lens.

BACKGROUND

Known light emitting diode (LED) lighting units include LEDs mounted on a heat sink and enclosed by a lens. The lens protects the LEDs and circuitry and may provide desired optical characteristics such as light diffusion. For example, if the LED lighting unit is designed to replace a conventional fluorescent bulb, LEDs are known to be mounted on a heat-sink that is encircled with a cylindrical lens, such as disclosed in U.S. Pat. No. 7,049,761.

BRIEF SUMMARY

The present invention teaches a LED lighting unit including an elongated heat sink having two spaced apart longitudinal grooves. The grooves can face tangentially or at an angle greater than an angle between a tangent of the lighting unit at the groove and a radius of the lighting unit at the groove. Further, at least one LED is mounted to the heat sink between the grooves, and the at least one LED is enclosed by a lens having bulged longitudinal edges. The lens is attached to the heat sink by sliding the bulged longitudinal edges into the grooves. The heat sink and lens form a housing that is less expensive to manufacture than known LED housings, has an improved thermal conductivity, and can accept less expensive diffusing means.

In additional embodiments, the LED light tube is configured to replace a conventional fluorescent light tube in a conventional fluorescent light socket. The LED light tube includes an elongated heat sink having a constant cross-section and two spaced apart longitudinal grooves, the grooves having cross-sections including a circular portion. The grooves are oriented to face tangentially in one embodiment, and are oriented to face in opposing directions in another embodiment. The heat sink additionally has a flat strip running longitudinally the length of the heat sink and fins projecting from the opposing side of the heat sink from the flat strip. A plurality of LEDs are in electrical communication with a printed circuit board, and the printed circuit board is mounted on the flat strip on the heat sink. An elongated substantially U-shaped lens having a constant cross-section includes bulged longitudinal edges. The bulged edges have a circular cross-section in order to be slidably engagable with the grooves on the heat sink, and the lens encloses the LEDs when installed. In the embodiment including opposing facing grooves, the lens has a bend shortly before each bulged longitudinal edge to permit the bulges to be slidably engagable with the grooves. A rectangular sheet of diffusing film is inserted between the heat sink and the lens, and at least one bi-pin electrical connector is connected to an end of the housing.

BRIEF DESCRIPTION OF THE DRAWINGS

The description herein makes reference to the accompanying drawings wherein like reference numerals refer to like parts throughout the several views, and wherein:

FIG. 3 is a cross-sectional view of a second embodiment of a heat sink having grooves facing in opposite directions, a corresponding lens, and diffusing film inserted between the heat sink and lens;

FIG. 4 is a perspective view of a housing showing diffusing film in the process of being inserted into the housing;

FIG. 5 is a cross-sectional view of an alternative embodiment of a groove of the housing and an edge of the lens; and FIG. 6 is a cross-sectional view of yet another alternative embodiment of a groove of the housing and an edge of the lens.

DETAILED DESCRIPTION OF EMBODIMENTS OF THE INVENTION

Figure 1:
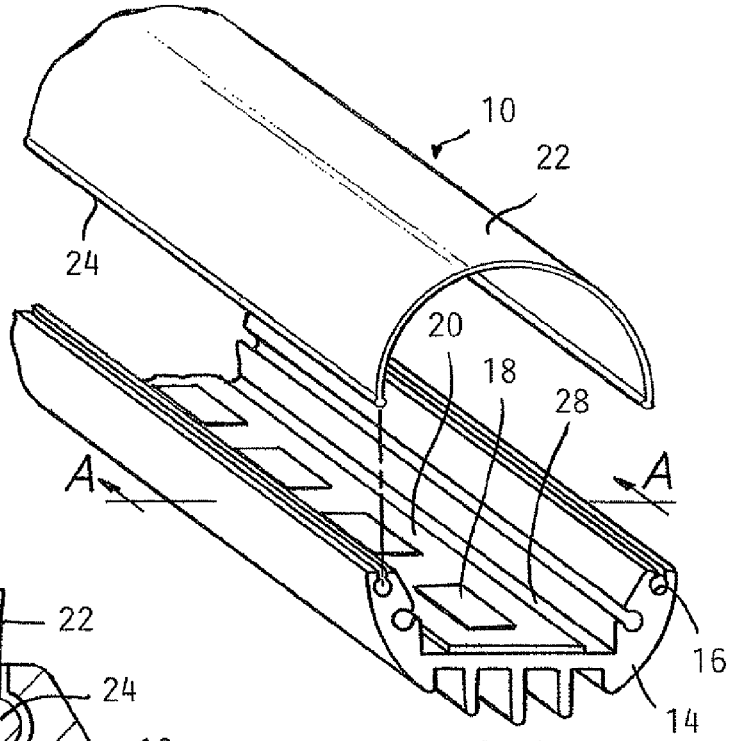
FIG. 1 is a perspective view of a housing including an elongated heat sink, a lens and LEDs mounted on the heat sink.

Embodiments of an LED lighting unit 10 with a housing 12 having a unique retention system are illustrated in FIGS. 1-4. As illustrated in FIG. 1, the housing 12 includes an elongated heat sink 14 having two spaced apart longitudinal grooves 16. The grooves 16 are arranged to face away from the main body of the housing 12 at an angle θ from a radius R extending from the center C of the lighting unit 10 that is at least as large as the angle β between a tangent T of the lighting unit 10 and the radius R. Herein, the direction a groove 16 "faces" is the direction toward which the longitudinally extending opening of the groove 16 is oriented. The lighting unit 10 also includes LEDs 18 fixed to a printed circuit board (PCB) 20 mounted on the heat sink 14 and an elongated lens 22 having bulged longitudinal edges 24 slidably engaged with the grooves 16 on the heat sink 14 such that the elongated lens 22 encloses the LEDs 18. Although the LEDs 18 are shown as surface-mounted components, the LEDs 18 can be discrete components. Also, although a plurality of surface-mounted LEDs are shown, one or more organic LEDs can be used in place of or in addition thereto.

The housing 12 can be shaped to be compatible with a conventional fluorescent socket. For example, the housing 12 can be 48" long with an approximately 1" diameter in order to fit a common fluorescent socket. The PCB 20 is shown in electrical communication with a conventional hi-pin connector 26 in FIG. 4 for physical and electrical connection to a conventional fluorescent tube socket.

Figure 2A:
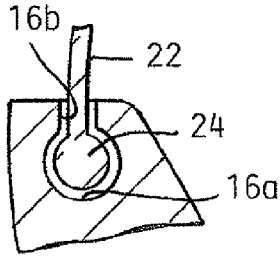
FIG. 2A is a detailed view of a portion of the housing of FIG. 2.
Figure 2:
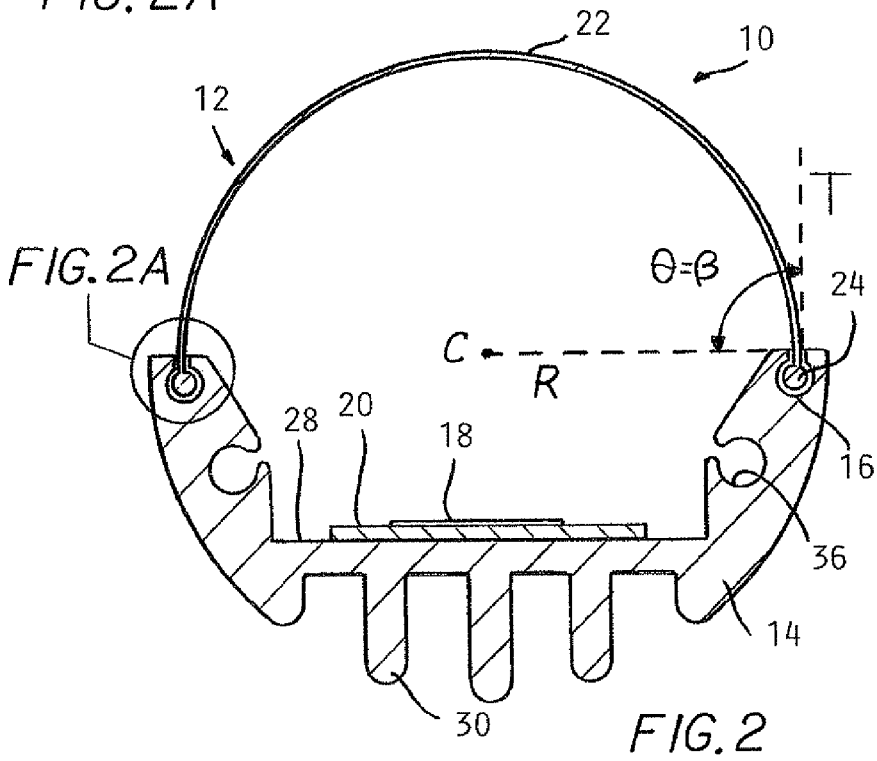
FIG. 2 is a cross-sectional view of a first embodiment of a heat sink including tangentially facing grooves taken along line A-A of FIG. 1.

FIGS. 2 and 3 illustrate embodiments of the heat sink 14. As illustrated in FIG. 2, an angle θ between the facing direction of the longitudinal grooves 16 and the radius R is equal to the angle β between the tangent of the housing 12 and the radius R. Note that because the housing 12 need not be cylindrical, the angle β between the tangent of the housing 12 and the radius R is not necessarily ninety degrees. Additionally, the grooves 16 have a first portion 16*a* with a circular cross-section to accept the bulged longitudinal edges 24 of the lens 22. The grooves 16 also have a second portion 16*b* with a narrower rectangular cross-section to prevent movement of the lens 22 in the direction the groove 16 faces. The rectangular portion 16*b* of the cross-section can include rounded edges to reduce manufacturing costs. The combination of the two portions 16*a*, 16*b* allows the grooves 16 to secure the lens 22 in directions orthogonal to the longitudinal direction of the grooves 16 as shown in FIG. 2A.

The grooves 16 can have alternatively-shaped cross-sections that are sufficient to secure the lens 22. For example, triangular, oval, T-shaped, L-shaped, and J-shaped sections are all capable of securing the lens 22 so long as the bulges 24 have compatible shapes. Also, while the grooves 16 are illustrated as extending the length of the heat sink 14, the grooves 16 can alternatively run only a certain length of the heat sink 14. For example, a single length of the heat sink 14 can include grooves 16 beginning at each end of the heat sink 14, but ending prior to the middle of the heat sink 14. Additionally, the grooves 16 need not be identical. For example, a first groove 16 can include a T-shaped cross-section while a second groove 16 can include an L-shaped cross-section to ensure that an asymmetrical lens 22 is installed correctly.

The heat sink 14 in the illustrated embodiment includes a flat strip 28 between the spaced apart grooves 16 that runs longitudinally the length of the heat sink 14. The flat strip 28 provides an area to mount a PCB 20. However, in place of a flat strip 28 for mounting a PCB 20, the heat sink 14 can include alternative geometries, such as bores or clips to receive LEDs 18. Likewise, the heat sink 14 can include snap-fit clips to secure the PCB 20. Otherwise, the PCB 20 can be fastened to the heat sink 20 with screws, glue, heat stakes, or other structures recognized as suitable by those of skill in the art based on the teachings in this application.

The heat sink 14 includes heat dissipating structures extending from the side opposite the flat strip 28 in a direction opposed to the lens 22, such as the illustrated fins 30 or other geometries recognized by those of skill in the art as providing increased thermal conductivity. These structures increase the surface area of the heat sink 14 in order to increase the thermal conductivity of the heat sink 14. Placing the structures close to the LEDs 18 provides a short path for heat to travel, though heat dissipating structures can also be included on additional or alternative portions of the heat sink 14, if desired. Alternatively, heat dissipating structures need not be included if the increase in thermal conductivity they provide is not necessary.

The heat sink 14 can also be configured to accept screws to secure a bi-pin connector 26 to the heat sink 14 (see FIG. 4). For example, additional grooves 36 are included in the embodiment illustrated in FIG. 2. The additional grooves 36 in FIG. 2 have an open edge and run the length of the heat sink 14 because the heat sink 14 in the figure is formed by extrusion. The grooves 36 are sized to accept conventional screws. The grooves 36 can be threaded, or self-tapping screws can be used to form the threads, depending on the material from which the heat sink 14 is constructed.

The heat sink 14 is FIG. 2 is formed by extruding a thermally-conductive material, such as aluminum, copper or a thermally-conductive plastic. As a result, the heat sink 14 has a constant cross-section. Alternatively, the heat sink 14 can be formed by molding or casting. The heat sink 14 formed need not necessarily have a constant cross-section when formed by one of these latter two processes. However, the grooves 16 in the heat sink 14 must have cross-sections that permit a lens 22 to be inserted. For example, the grooves 16 should not have a triangular cross-section that morphs into an L-shaped cross-section, as a bulge 24 is not be fully compatible with both shapes. However, the cross-section can have a non-constant shape and still permit a lens 22 to be inserted. For example, an end of the groove 16 can have a large circular cross-section to permit easy insertion of the lens 22. The groove 16 can then taper into a small circular cross-section so that a friction fit secures the lens 22 in place axially.

FIG. 3 illustrates a second embodiment of the heat sink 14. The grooves 16 in the second embodiment are oriented to face in opposing directions. Further, the angle θ in which the grooves face is greater than the angle β between the tangent T and the radius R by about ninety degrees. Grooves 16 oriented to face an angle θ greater than the angle β permit the use of a lens 22 with bends 32, which add strength to the lens 22 as discussed below. Additionally in the embodiment of FIG. 3, the additional grooves 36 configured to accept screws are illustrated as opening to the exterior of the housing 12. When a self-tapping screw is used, installation of the screw creates loose shaving of material. Having the grooves 36 open to the exterior of the light unit 10 prevents the shavings from being trapped within the light unit 10.

The heat sink 14 illustrated in FIG. 3 has the same features as the heat sink 14 illustrated in FIG. 2, with the exception of the orientation of the grooves 16.

While FIGS. 2 and 3 illustrate the grooves facing tangentially and in opposing directions, respectively, the grooves 16 can face alternate angles θ greater than the angle β. For example, if desired, the grooves 16 can be oriented to face at an angle θ forty-five degrees greater than the position shown in FIG. 3. Or, the grooves 16 can be oriented to face midway between the positions shown in FIGS. 2 and 3. However, the shape of the lens 22 may limit how large the angle θ can be. When the grooves 16 are oriented at very large angles θ, the lens 22 includes sharp bends 32 in order to be compatible with the heat sink 14. Moreover, the two grooves 16 need not be oriented to face the same angle θ. For example, one groove 16 can face tangentially and the other groove 16 can face ninety degrees further outward than tangentially.

FIGS. 2 and 3 also illustrate embodiments of the lens 22. The cross-section of the lens 22 as illustrated is substantially U-shaped with a bulge 24 on each longitudinal edge. However, lens 22 need not be substantially U-shaped. The cross-section of the lens 22 can include straight edges and/or various curved portions, so long as the lens 22 is shaped to permit the bulged edges 24 to engage with the heat sink 14 and to cover the LEDs 18. Moreover, multiple lenses 22 can be used if desired. For example, a first lens 22 can be inserted at one end of the heat sink 14 and extend half the length of the heat sink 14, and a second lens 22 can be inserted at the opposing end of the heat sink 14 to cover the remaining portion of the heat sink 14.

The longitudinal edges of the lens 22 include bulges 24. The bulges 24 are illustrated as having circular cross-sections, though the cross-sectional can alternatively be triangular, oval, T-shaped, L-shaped or have an alternative shape that restricts the motion of the edges of the lens 22 to sliding in the longitudinal direction of the grooves 16 when assembled. The bulges 24 need not have a thickness greater than the thickness of other portions of the lens 22. For example, as illustrated in FIG. 5, the bulge 24 can be include a first portion 24*a* having extending generally toward the center C of the housing 12 and a second portion 24*b* extending at an angle to the first, with both portions 24*a*, 24*b* having the same thickness as the lens 22. Bulges 24 having this shape, an L-shape as illustrated in FIG. 6, a J-shape, or a similar shape can be formed by bending a rectangular piece of lens material. If desired, the bulges 24 need not have constant cross-sections. For example, the bulges 24 can begin with small cross-sections to enable easy insertion into the grooves 16 on the heat sink 14, and then the cross-sections can become larger moving longitudinally down the edges of the lens 22 to enable a tight fit between the grooves 16 and the bulges 24. Also, as illustrated in FIG. 2, the lens 22 is nearly straight in the region immediately prior to the bulge 24. The nearly straight portions of the lens 22 occupy the rectangular cross-section portions 16*b* of the grooves 16 when the housing 12 is assembled, permitting the circular cross-section portions 16*a* of the grooves 16 to wrap almost completely around the bulges 24 to prevent the bulges 24 from moving out of the grooves 16 in the facing direction of the grooves 16.

The lens 22 in FIGS. 2 and 3 can be formed by extrusion in order to achieve a constant cross-section. Alternatively, the lens 22 could be formed by a different manufacturing process, such as molding. The lens 22 can be constructed of polycarbonate, acrylic, glass or other materials recognized as suitable by one of skill in the art. The lens 22 can also include light diffusing structures, such as ridges, dots, bumps, dimples, and other uneven surfaces, or the lens can be formed of a diffusing material. The lens 22 can be clear or translucent, depending on the desired use and whether a separate diffusing means is used.

As illustrated in FIG. 3, the lens 22 features substantially right angled bends 32 immediately prior to the bulged edges 24. This lens 22 shape corresponds to the embodiment of the heat sink 14 with opposing facing grooves 16, also shown in FIG. 3. The bends 32 provide structural reinforcement of the lens 22. For example, the bends 32 increase the stiffness of the lens 22. Increasing the stiffness of the lens 22 makes assembly easier, and the additional stiffness also permits the lens 22 to provide more protection during operation. The bends 32 need not include sharp corners and can instead include rounded corners in order to reduce manufacturing costs. Also, bends 32 can be included on other embodiments when the angle $\theta$ that the grooves 16 face is greater than the angle $\beta$. Otherwise, the lens 22 in FIG. 3 has the same features as the lens 22 in FIG. 2.

As illustrated in FIGS. 3 and 4, diffusing film 34 can be included in the lighting unit 10 if desired. Thin sheets of diffusing film 34, such as 0.005" thick PET or polycarbonate available from Luminit, Inc., can be bent and inserted between the heat sink 14 and the lens 22 as illustrated in FIG. 4. Once inserted, the film 34 becomes unbent to form a lining for the lens 22. Alternatively, the diffusing film 34 can be pressed against the interior of the lens 22 prior to inserting the bulged edges 24 of the lens 22 into the grooves 16. Using either insertion method, the film 34 can be inserted such that the longitudinal edges of the film 34 are held between the lens 22 and the heat sink 14 adjacent to the bulged edges 24 of the lens in order to ensure the film 34 remains. Alternatively, a light transmitting resin can be applied to the lens 22 to provide diffusion in place of the diffusing film 34. The film 34 or resin can be used alone or with light extraction structures, such as small ridges, dots, bumps, dimples and other uneven surfaces located on or in the surface of the lens 22 and designed to diffuse light.

The LEDs 18 included in the LED lighting unit 10 emit white light. However, if desired, LEDs 18 that emit blue light, ultra-violet light or other wavelengths of light, such as wavelengths with a frequency of 400-790 THz corresponding to the spectrum of visible light, can be included. PCBs 20 make up the electric circuitry in the illustrated embodiments. However, other types of circuit boards, for example metal core circuit boards, can be used in place of PCBs 20. Alternatively, the circuitry can be formed directly on the flat strip 28 on the heat sink 14, such as by depositing copper on the heat sink 14 before assembly. Likewise, wires can be used in place of a printed circuit board 20, so long as the LEDs 18 are electrically connected and adequately secured to the heat sink 14. When wires are used, LEDs 18 can be glued directly to the heat sink 14 or snap-fit to clips on the heat sink 14. Because the danger of LED 18 failure is low, the LEDs 18 can be connected in series or parallel.

To facilitate a physical and electrical connection with a conventional fluorescent lighting fixture, one or more bi-pin electrical connectors 26 are attached to ends of the housing 12. The connectors 26 include a transformer, if necessary, and any other required electrical components to supply power from at least one pin of the connectors 26 to the LEDs 18. Alternatively, the electrical components can reside in a portion of the housing 12. Alternative connectors 26, for example single pin connectors, can be used if the lighting unit 10 is not intended to be installed in a conventional fluorescent light socket.

To assemble the LED lighting unit 10 as shown, the LEDs 18 are fixed to PCB 20, which is then mounted to the heat sink 14. The bulged edges 24 of the lens 22 are inserted into the grooves 16 on the heat sink 14 at one end of the heat sink 14, and the lens 22 is slid the length of the heat sink 14. If diffusing film 34 is desired, it can be bent into a round shape and inserted into the housing 12. Alternatively, the diffusing film 34 can be placed on the interior of the lens 22 prior to installation of the lens 22 in order to secure the film 34 between the lens 22 and the heat sink 14 near the grooves 16. Bi-pin connectors 26 can be attached via the additional grooves 36 so the lighting unit 10 can be installed in a conventional fluorescent socket.

The ability to assemble the housing 12 by inserting the bulged longitudinal edges 24 of the lens 22 into the grooves 16 on the heat sink 14 reduces manufacturing costs compared to the known methods of gluing or using heat stakes to attach a conventional heat sink to a cylindrical lens. Additionally, if diffusion is desired, the housing 12 allows the use of diffusing film 34 that is cut from a flat sheet, then bent and inserted into housing 12. This method of obtaining diffusion is less expensive than engaging in the manufacturing processes required for applying light diffusion techniques to the lens 22, such as by molding the lens 22 to include the diffusing ridges, dots, bumps, or other uneven surfaces. Moreover, the heat sink 14 is exposed to the environment external of the lens 22. The exposure permits the heat sink 14 to transfer a greater amount of heat to the ambient environment to better cool the LEDs 18 and PCB 20 than an enclosed heat sink. Finally, forming the heat sink 14 to include additional grooves 36 configured to accept screws reduces the number of manufacturing steps required compared to drilling screw holes, and thus also decreases the cost of manufacturing the lighting unit 10. The above-described embodiments have been described in order to allow easy understanding of the invention and do not limit the invention. On the contrary, the invention is intended to cover various modifications and equivalent arrangements included within the scope of the appended claims, which scope is to be accorded the broadest interpretation so as to encompass all such modifications and equivalent structure as is permitted under the law.

What is claimed is:

1. A LED lighting unit comprising:

an elongated heat sink having two spaced apart longitudinal grooves and forming a single cavity with a flat surface therebetween, wherein an angle between a facing direction of each groove and a radius extending from a center of the lighting unit to an opening of the groove is at least as large as the angle between a tangent of the lighting unit at the opening of the groove and the radius;

at least one LED mounted to the flat surface of the heat sink between the grooves and within the cavity; and an elongated lens having bulged longitudinal edges, each edge slidably engaged with the groove on the heat sink such that the elongated lens encloses the at least one LED.

2. The LED lighting unit of claim 1, wherein the facing direction of the each groove is tangential relative to a perimeter of the lighting unit.

3. The LED lighting unit of claim 1, wherein the facing directions of the grooves oppose each other, and wherein the lens includes a bend toward an interior of the lighting unit near each bulged longitudinal edge.

4. The LED lighting unit of claim 3, wherein the grooves face ninety degrees to the exterior of the tangent, and the angle of the bend is ninety degrees.

5. The LED lighting unit of claim 1, wherein the lens has a constant cross-section along its longitudinal length.

6. The LED lighting unit of claim 5, wherein the lens has a substantially U-shaped cross-section along its longitudinal length.

7. The LED lighting unit of claim 5, wherein the bulges on the bulged longitudinal edges have a circular cross-section, and wherein the cross-section of the grooves includes a circular-shaped section.

8. The LED lighting unit of claim 1, wherein the at least one LED includes at least one of an LED emitting ultraviolet light and an LED emitting colored light.

9. The LED lighting unit of claim 1, further comprising:

a printed circuit board electrically connecting the LEDs and mounted on the flat surface of the heat sink between the grooves.

10. The LED lighting unit of claim 1, wherein the heat sink has a constant cross-section along its longitudinal length.

11. The LED lighting unit of claim 10, further comprising:

at least one additional groove in a surface of the heat sink between the flat surface and the grooves, each additional groove configured to accept a screw to secure an end cap to the heat sink.

12. The LED lighting unit of claim 11, wherein the at least one additional groove opens to the exterior of the heat sink and extends the length of the heat sink.

13. The LED lighting unit of claim 10, further comprising:

a printed circuit board electrically connecting the LEDs and mounted to the flat surface between the two grooves.

14. The LED lighting unit of claim 10, wherein the heat sink includes a plurality of heat dissipating structures.

15. The LED lighting unit of claim 14, wherein the heat dissipating structures include fins projecting from an opposing side of the flat surface of the heat sink in a direction opposite from the LEDs.

16. The LED lighting unit of claim 1, further comprising:

an elongated sheet of diffusing film inserted between the heat sink and the lens.

17. The LED lighting unit of claim 16, wherein longitudinal edges of the diffusing film are located between the lens and the heat sink adjacent to the bulged edges.

18. The LED lighting unit of claim 1, further comprising:

two bi-pin electrical connectors disposed at opposing ends of the lens and heat sink, and wherein the lens and heat sink are configured to be part of a bulb placed in a conventional fluorescent tube socket.

19. The LED lighting unit of claim 1, wherein the thickness of the bulges is the same as the thickness of the lens.

20. An LED light tube configured to replace a conventional fluorescent light tube in a conventional fluorescent light socket, the LED light tube comprising:

an elongated heat sink having a constant cross-section along its longitudinal length, the heat sink including two spaced apart, tangentially facing, longitudinal grooves, a flat strip between the grooves, and a plurality of fins projecting from the flat strip on the opposite side as the grooves, the grooves each having a cross-section including a circular portion;

a plurality of LEDs in electrical communication with a printed circuit board, the printed circuit board mounted on the flat strip;

an elongated, substantially U-shaped lens having a constant cross-section including bulged longitudinal edges having a circular cross-section, the edges slidably engaged with the grooves on the heat sink to form a housing that covers the LEDs;

a sheet of diffusing film inserted between the heat sink and the lens; and at least one electrical connector in electrical communication with the printed circuit board, the electrical connector attached to an end of the housing.

21. An LED light tube configured to replace a conventional fluorescent light tube in a conventional fluorescent light socket, the LED light tube comprising:

an elongated heat sink having a constant cross-section, the heat sink including two spaced apart longitudinal grooves facing in opposing directions and having a cross-section including a circular portion, a flat strip between the grooves, and a plurality of fins projecting from the heat sink on the opposite side as the flat strip;

a plurality of LEDs in electrical communication with a printed circuit board, the printed circuit board mounted on the flat strip;

an elongated, substantially U-shaped lens having a constant cross-section including bulged longitudinal edges having a circular cross-section, the lens including a bend toward the interior of the light tube near the bulged longitudinal edge, the edges slidably engaged with the grooves in the heat sink to form a housing that covers the LEDs;

a sheet of diffusing film inserted between the heat sink and the lens; and at least one electrical connector in electrical communication with the printed circuit board, the electrical connector attached to an end of the housing.

* * * * *